US008087209B2

(12) United States Patent
Sondermann

(10) Patent No.: US 8,087,209 B2
(45) Date of Patent: Jan. 3, 2012

(54) EDGING RAIL FOR A FLOORING

(75) Inventor: David Sondermann, Drolshagen (DE)

(73) Assignee: Kueberit Profile Systems GmbH & Co. KG, Luedenscheid (DE)

( * ) Notice: Subject to any disclaimer, the term of this patent is extended or adjusted under 35 U.S.C. 154(b) by 0 days.

(21) Appl. No.: 12/693,349

(22) Filed: Jan. 25, 2010

(65) Prior Publication Data

US 2010/0186331 A1 Jul. 29, 2010

(30) Foreign Application Priority Data

Jan. 27, 2009 (DE) ..... 20 2009 001 036 U

(51) Int. Cl.
*E04C 2/38* (2006.01)

(52) U.S. Cl. ..... 52/716.8; 52/716.1; 52/463; 52/464; 52/288.1

(58) Field of Classification Search ..... 52/6, 7, 52/459, 461, 463, 464, 465, 396.04, 716.1, 52/288.1, 211, 716.8
See application file for complete search history.

(56) References Cited

U.S. PATENT DOCUMENTS

| | | | | |
|---|---|---|---|---|
| 3,732,659 | A * | 5/1973 | LaBarge | 52/461 |
| 4,653,138 | A * | 3/1987 | Carder | 16/4 |
| 5,155,952 | A * | 10/1992 | Herwegh et al. | 52/100 |
| 6,230,385 | B1 * | 5/2001 | Nelson | 29/450 |
| 6,345,480 | B1 * | 2/2002 | Kemper et al. | 52/395 |
| 6,357,192 | B1 * | 3/2002 | Schluter | 52/459 |
| 6,588,165 | B1 * | 7/2003 | Wright | 52/506.05 |
| 6,591,575 | B2 * | 7/2003 | Benedettini | 52/716.1 |
| 6,973,754 | B2 * | 12/2005 | Iguchi et al. | 52/208 |
| 7,784,237 | B2 * | 8/2010 | Stanchfield | 52/464 |
| 7,784,238 | B2 * | 8/2010 | Bannister | 52/465 |
| 7,814,720 | B2 * | 10/2010 | Neuhofer | 52/471 |
| 7,937,896 | B1 * | 5/2011 | Lippie | 52/101 |
| 2002/0095895 | A1 * | 7/2002 | Daly et al. | 52/464 |
| 2003/0221388 | A1 * | 12/2003 | Benedettini | 52/716.1 |
| 2007/0283654 | A1 * | 12/2007 | Stanchfield et al. | 52/465 |

* cited by examiner

*Primary Examiner* — Eileen D Lillis
*Assistant Examiner* — Alp Akbasli
(74) *Attorney, Agent, or Firm* — Robert L. Epstein; Epstein Drangel LLP

(57) ABSTRACT

An edging rail for a flooring (2) has a base member (3) and a covering member (4). These are integrally joined together. In order to fix the edging rail effectively to the flooring (2), at least one drive channel (10) is supported on the base member (3). Engaging in this drive channel (10) is at least one screw (11), which passes through a bore (12) in the covering member (4).

4 Claims, 2 Drawing Sheets

EDGING RAIL FOR A FLOORING

Figure 1:
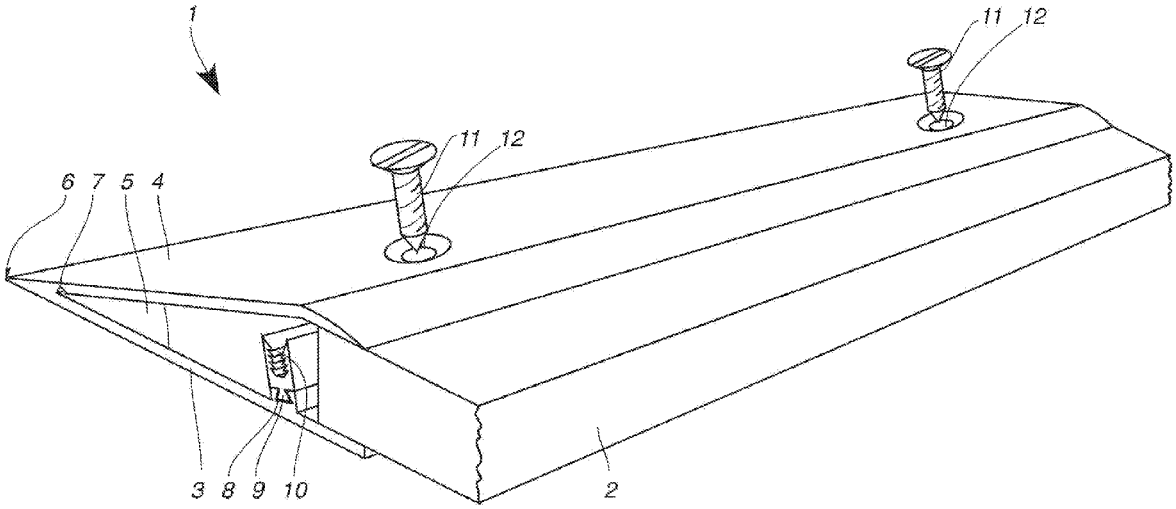

The invention relates to an edging rail for a flooring.

DE 20 2005 004 624 U1 discloses a profiled rail system which is formed by a base profile, a swivel joint, a cover profile and a pivotable covering blade. Between the base profile and the pivotable covering profile, a flooring element can be held clamped. The profiled rail system here forms an edging rail for the flooring.

From U.S. Pat. No. 4,913,576, a profiled rail of the generic type is known. This consists of a base rail and a cover rail, which are integrally joined together by a web. The cover rail can here be elastically deformed, so that it can be forced away from the base rail. Following the insertion of a flooring between the base rail and the cover rail, the cover rail then presses elastically against the flooring.

This profiled rail system has been proven in practice and forms the starting point for the present invention.

The object of the invention is to provide an edging rail of the type stated in the introduction, which is characterized by a simple structure.

This object is achieved according to the invention with the following features.

An edging rail serves as an edging for a flooring, in particular a parquet, laminate or stone floor. This list should not be regarded as final, however, but merely as illustrative. The edging rail has a base member and a cover member which overlaps the flooring.

For adaptation to different flooring thicknesses, the distance between the base member and the covering member is made adjustable. In this way, a sufficiently universal applicability of the edging rail is obtained. In order to obtain as simple a structure as possible, the covering member is integrally connected to the base member. Although this appears in principle to be at variance with the required height adjustability of the cover member, it is only in this way that the simplest possible design structure of the edging rail can be obtained. The height adjustability is realized, for example, by an elastic and/or plastic deformability of the edging rail. In order to be able to brace the covering member against the base member, supported on the base member is at least one drive channel, in which at least one screw can engage. This screw here passes through at least one bore in the covering member, so that, when the screw is screwed into the drive channel, the two members are pressed one against the other.

In order to obtain sufficient height adjustability between the covering member and the base member in spite of the one-piece structure, it is favourable if the covering member and/or the base member has at least one predetermined bending point. This predetermined bending point is here formed by a cross-sectional taper, so that the edging rail can be easily manufactured as a one-piece component by extrusion methods. Moreover, the fitting of the edging rail to the flooring is thereby facilitated, since the predetermined bending point applies a moderate spring force to the two members, which drives these apart. This makes it easier to place the edging rail onto the flooring.

Particularly for use of the edging rail as a ramp, it is advantageous if the covering member and the base member form an acute angle.

In order to obtain a simple production of the edging rail, it is favourable if the driving channel is held on the base member by means of an undercut tongue-and-groove profiling. This facilitates, in particular, the manufacture of the edging rail by extrusion methods.

In addition the force for fixing the cover member can also be generated by latching means. Both the base members and the covering member here have corresponding latching means, which are preferably formed by interlocking saw-tooth profilings. These latching means allow a compression of the edging rail. By contrast, a pulling apart of covering member and base member is not possible, or only with increased force. In this way, no fastening means are visible from the outside.

In order to hold the edging rail firmly on the flooring, the base member grips the flooring on the bottom side, whilst the covering member grips it on the top side. A clamping grip is hereby obtained, which ensures a good fixing of the edging rail to the flooring. An additional connection of the edging rail to a foundation surface is here possible in principle, but is not necessary. The edging rail has a base member and a covering member which overlaps the flooring.

Further advantages and features of the present invention are presented in the following detailed description with reference to the accompanying figure which contains an exemplary embodiment of the present invention. It should be understood, however, that the drawing serves merely for the purpose of illustrating the invention and does not restrict the scope of protection of the invention.

Figures 2, 3:
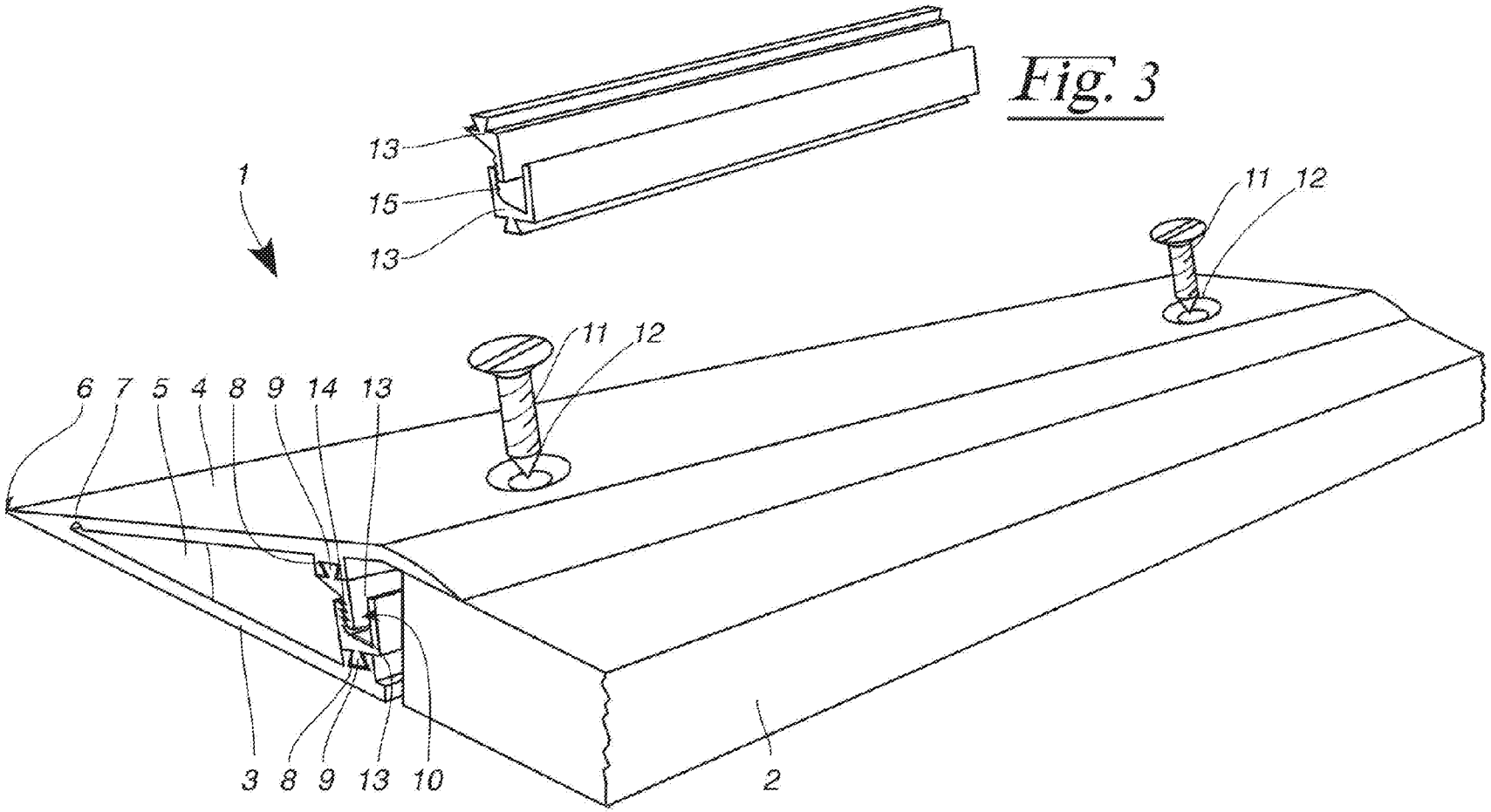

To these and to such other objects that may hereinafter appears, the present invention relates to an edging rail for a flooring as described in detail in the following specification and recited in the annexed claims, taken together with the accompanying drawing in which shows:

FIG. 1 shows a three-dimensional representation of a first embodiment of an edging rail, FIG. 2 shows a three-dimensional representation of a second embodiment of an edging rail, and FIG. 3 shows a three-dimensional representation of two latching webs.

FIG. 1 shows a three-dimensional representation of an edging rail 1 for a flooring 2. The edging rail 1 is here preferably made of metal, in particular aluminium, or of plastic. The edging rail 1 has a base member 3 and a covering member 4, which together form an acute angle 5. In the region of a point 6, at which the base member 3 and the covering member 4 converge, a predetermined bending point 7 in the form of a cross-sectional taper is provided in the covering member 4. This predetermined bending point 7 allows a pivoting of the covering member 4 in relation to the base member 3 in spite of the one-piece structure of the edging rail 1. Alternatively or additionally, a corresponding cross-sectional taper can also be provided in the base member 3.

Moulded into the base member 3 is an undercut groove 8, in which a tongue 9 of a drive channel 10 is held. The drive channel 10 is penetrated by screws 11, which pass through bores 12 in the covering member 4. Through tightening of the screws 11 in the drive channel 10, the covering member 4 and the base member 3 are pressed one against the other. Between the covering member 4 and the base member 3, the flooring 2 is held clamped. In this way, the edging rail 1 is fixed directly to the flooring 2. Although an additional securement of the edging rail 1 to a foundation surface, for example by gluing or screwing, is possible, it is no longer necessary. This is particularly important in those cases in which the foundation must not be damaged, which is frequently the case, in particular in exhibition centres or in sales rooms.

Alternatively, the base member 3 can also be of shortened configuration, so that the flooring 2 no longer comes to lie on the base member 3. In this case, the edging rail 1 no longer grips the flooring 2 in a clamping grip, so that a securement of the edging rail 1 to a foundation is imperative. This variant is to be preferred, in particular, in the case of soft floorings 2 such as carpets or PVC coverings.

FIG. 2 shows an alternative embodiment of an edging rail 1 according to FIG. 1, wherein the same reference symbols denote the same parts. Below, only the differences relative to the embodiment according to FIG. 1 are discussed.

In the embodiment according to FIG. 2, the covering member 4 is likewise secured by a screw 11, which engages in a driving channel 10. In addition, latching webs 13 are held both on the base member 3 and on the covering member 4 by means of corresponding tongue-and-groove profilings 8, 9. These latching webs 13 have saw-tooth profilings 14, which are of interlocking configuration. When the covering member 4 and the base member 3 are mutually pressed together, these latching webs 13 slide one over the other, whereupon the saw-tooth profilings 14 catch together. Alternatively, the latching webs 13 could also have interlocking corrugations or similar profilings. This facilitates, in particular, the removal of the edging rail. In addition, the latching webs 13 form the drive channel 10 for the screw 11.

In this embodiment, the base member 3 is also made shorter, so that the flooring 2 comes to lie next to the base member 3. In this case, the edging rail 1 must be glued to the foundation.

Finally, FIG. 3 shows a three-dimensional representation of two latching webs 13. These latching webs 13 can replace the latching webs 13 of the embodiments according to FIGS. 1 and 2. Instead of the saw-tooth profilings 14, they have corrugations 15. These corrugations 15 allow a simple removal of the edging rail 1.

It is also envisaged to mutually combine features of all the embodiments in an optional manner.

Since some exemplary embodiments of the present invention are not shown or described, it must be understood that a multiplicity of changes and modifications of this exemplary embodiment described are possible, without departing from the essential idea and scope of protection of the invention defined by the claims.

REFERENCE SYMBOL LIST

1 edging rail
2 flooring
3 base member
4 covering member
5 acute angle
6 point
7 predetermined bending point
8 groove
9 tongue
10 drive channel
11 screw
12 bore
13 latching web
14 saw-tooth profiling
15 corrugation

The invention claimed is:

1. Edging rail for a flooring having a thickness, said edging rail being a one-piece structure comprising at least one substantially planar covering member and at least one base member, said at least one covering member and said at least one base member converging at an acute angle along at least one bending point and separated at the end opposite said bending point such that said covering member at least partially overlaps said flooring, means for adjusting the distance between said covering member and said base member in the region of the partial overlap, so as to adapt to said thickness of said flooring, and at least one drive channel fixed on said base member, in which at least one screw can engage, said screw passing through at least one bore in said covering member;

and wherein said driving channel is held on said base member by means of at least one undercut tongue-and-groove profiling.

2. Edging rail according to claim 1, wherein said bending point is formed by a cross-sectional taper.

3. Edging rail according to claim 1, wherein on said base member and on said covering member interlocking latching means are provided.

4. Edging rail according to claim 1, wherein said flooring is held clamped between said base member and said covering member.

* * * * *